United States Patent [19]

Yamura et al.

[11] Patent Number: 4,556,202

[45] Date of Patent: Dec. 3, 1985

[54] UNDER-HEATER TYPE FURNACE

[75] Inventors: Hitoo Yamura, Togane; Kakuro Ikeda, Tokyo; Yuhichi Sakai, Togane, all of Japan

[73] Assignee: Toshiba Ceramics Co., Ltd., Tokyo, Japan

[21] Appl. No.: 584,348

[22] Filed: Feb. 28, 1984

[30] Foreign Application Priority Data

Mar. 4, 1983 [JP] Japan ..... 58-34410
Nov. 14, 1983 [JP] Japan ..... 58-212448

[51] Int. Cl.[4] ..... F27B 14/02

[52] U.S. Cl. ..... 266/242; 266/280; 266/900

[58] Field of Search ..... 266/242, 900, 901, 200, 266/275, 99, 280; 432/209

[56] References Cited

U.S. PATENT DOCUMENTS

| | | | |
|---|---|---|---|
| 2,271,168 | 1/1942 | Booth | 266/900 |
| 3,724,447 | 4/1973 | Parkhill et al. | 266/900 |
| 4,033,564 | 7/1977 | Junghanns et al. | 266/242 |
| 4,367,866 | 1/1983 | Acker et al. | 266/99 |
| 4,399,981 | 8/1983 | Nömtak | 266/275 |

FOREIGN PATENT DOCUMENTS

| | | | |
|---|---|---|---|
| 0020784 | 2/1983 | Japan | 266/280 |
| 0050135 | 3/1984 | Japan | 266/242 |
| 0511040 | 8/1939 | United Kingdom | 266/200 |

*Primary Examiner*—L. Dewayne Rutledge
*Assistant Examiner*—S. Kastler
*Attorney, Agent, or Firm*—Pahl, Lorusso & Loud

[57] ABSTRACT

An under-heater type furnace for maintaining a molten metal at a high temperature, comprising a refractory vessel made of an integral castable material for containing the molten metal, a heat insulating layer made of a ceramic fiber material and fixed outside of the refractory vessel for covering thermally the refractory vessel, a heater, a protective tube made of ceramics and having a closed end and an open end for housing the heater and protecting the heater from the molten metal in the refractory vessel, the refractory vessel having a first support at a lower side portion thereof and a second support at an opposite side portion thereof, the first support having a tapered opening wall which is outwardly widened, a sealing material disposed between the tapered opening wall and the protective tube for fixing the protective tube relative to the vessel, the second support supporting the closed end of the protective tube in such a manner that the closed end of the protective tube can freely move relative to the second support.

12 Claims, 7 Drawing Figures

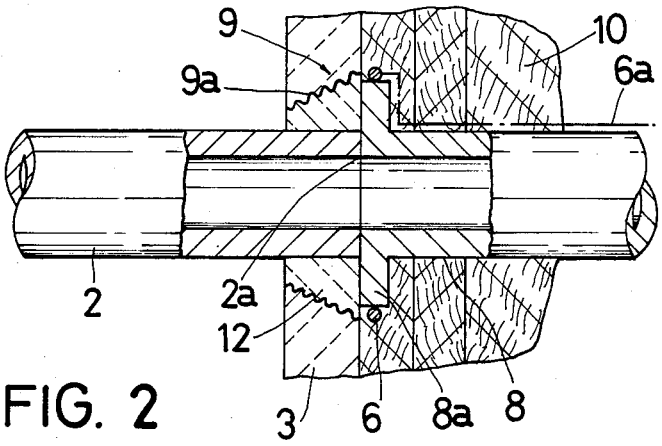
FIG. 2
FIG. 7
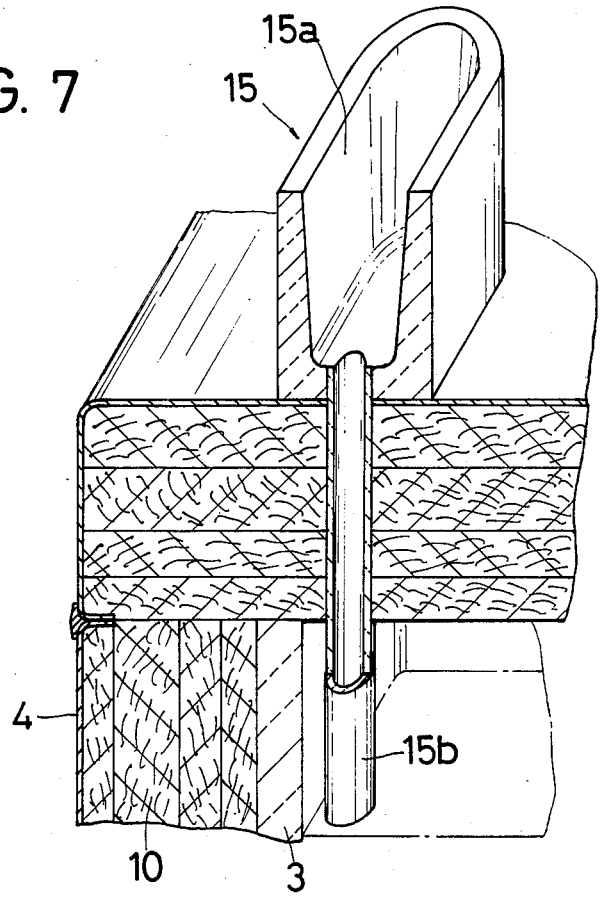

UNDER-HEATER TYPE FURNACE

BACKGROUND OF THE INVENTION

This invention relates to an under-heater type furnace for maintaining a molten metal at a high temperature, and more particularly an under-heater type furnace for the purpose of maintaining a low melting point metal such as an aluminum alloy, for example, at a high temperature of 680°–720° C. after deoxidization treatment, slag removing treatment and etc. prior to diecasting.

In such a type of conventional furnaces, gas or oil burners or electric heaters are used as means for heating a molten metal such as an aluminum alloy. Also, conventional furnaces are of an upper-heater type and an under-heater type. Further, in such an under-heater type of furnaces, various modes of fixing the heating means are employed. For example, in a prior art furnace, both ends of a protective tube for housing therein a heater penetrates through and are fixed between opposite side walls of the furnace. In another conventional under-heater type furnace, only one end of a protective tube for a heater is fixed at a side wall of the furnace.

In the conventional under-heater type furnaces of the two-end fixing type, a protective tube for housing a heater is apt to be broken due to its heat expansion. Also, a seal between the protective tube and the furnace side wall is easily broken. Its construction is complicated, which results in difficult working and assembling.

In the conventional furnaces of one-end fixing type, it is very difficult to support a long protective tube. For such a reason, even if the protective tube is inclined, a sealing portion between the protective tube and the furnace side wall may break so as to cause a molten metal to be leaked. Accordingly, in practice, only a short protective tube is employed. Thus, heat efficiency is bad.

SUMMARY OF THE INVENTION

The object of this invention is to provide an under-heater type furnace for maintaining a molten metal at a high temperature, which can prevent a protective tube for a heater and a sealing material disposed between the protective tube and a furnace side wall from breaking.

A refractory crucible or vessel is made of a castable material. Preferably, the castable material consists essentially of $Al_2O_3$ of 50–99 wt% and $SiO_2$ of 0.05–50 wt% because Si contained in the castable material reacts to Al in a molten aluminum alloy. In this respect, a BN coating can be provided on the inner surface of the refractory vessel.

A heat insulating layer is made of a ceramic fiber material which preferably has excellent heat insulating characteristics in order to decrease consumption of electric power or gas. It is preferable that the heat insulating layer consists of multi-layer type plural blankets.

A heater may be an electric heater or a gas burner. The electric heater may be made of a well-known metal or silicon carbide.

A protective tube is made of conventional ceramics. The protective tube is preferably made of SiC ceramics having good corrosion and heat resistances in case of an aluminum alloy.

If an electric heater made of SiC or the like is inserted into a protective tube, a filling such as ceramic fibers, magnesia powder or the like is preferably disposed between the heater and the protective tube in order to stop a leaked molten metal thereat to a reasonable degree.

Preferably, a sealing material is a mortar which includes fibers. It is preferable to use a colloidal mortar containing carbon fibers or alumina-silica fibers.

The refractory vessel has a first support at a lower side wall and a second support at an opposite side wall thereto. The second support is preferably in a step form at a lower end portion of the side wall of the vessel. The protective tube has a closed end and an open end. The closed end of the protective tube is supported and not fixed by the second support in such away that the closed end of the protective tube can move relative to the second support. The protective tube is fixed at the first support. As the protective tube extends between the opposite side walls of the furnace, a long protective tube can be used. It can improve heat efficiency.

The furnace has at its side wall a tapered opening wall which is outwardly widened. The tapered opening wall preferably has tapered threads through which the protective tube penetrates.

The sealing material is disposed between the protective tube and the tapered opening wall. The protective tube can be fixed by the sealing material. The sealing area of the sealing material is large so as to obtain good sealing. If the protective tube expands due to heat, the sealing material is pressed against the tapered opening wall and particularly the tapered threads so that the sealing becomes more effective. Also, the sealing material can be prevented from removing.

The open end of the protective tube preferably ends at an outside portion of the vessel and is joined to one end of an auxiliary tube made of a ceramic fiber material having heat insulation which extends through the heat insulating layer. The auxiliary tube has a flange for contacting the sealing material and the open end of the protective tube.

Preferably, a plurality of the protective tubes each housing the heater are horizontally arranged in parallel to each other.

A sensor has a portion for detecting leakage of a molten metal between the protective tube and the tapered opening wall. The detecting portion is placed near the sealing material and connected by way of a lead wire to a control unit placed outside of the furnace. The detecting portion may be a stainless wire, a nichrome wire or the like. The sensor may be of electric resistance type or heat sensitive type.

A partition wall is preferably formed in the vessel for defining a molten metal ladling chamber. The partition wall can be omitted. For example, the partition defines a first chamber constituing the ladling chamber, a second chamber for pouring the molten metal, and a third chamber positioned between the first and second chambers for detecting the temperature and level of the molten metal in the vessel. The first, and third chambers are connected thorugh an opening formed in a lower portion of the partition wall. The second and third chamber are connected through an opening formed in a lower portion of the partition wall.

A small enclosure for closing only the first chamber or ladling chamber is separate from a main enclosure. As only this small enclosure can be opened, heat radiation can be minimized when the molten metal is ladled. The enclosures include a ceramic fiber layer.

BRIEF DESCRIPTION OF THE DRAWINGS

FIG. 2 shows a en larged section of a sealing material and its related members of the first embodiment in which a heater is omitted, FIG. 7 is a sectional view showing a pouring portion of the furnace shown in FIGS. 1 and 3.

DETAILED DESCRIPTION OF THE PREFERRED EMBODIMENTS

Figure 1:
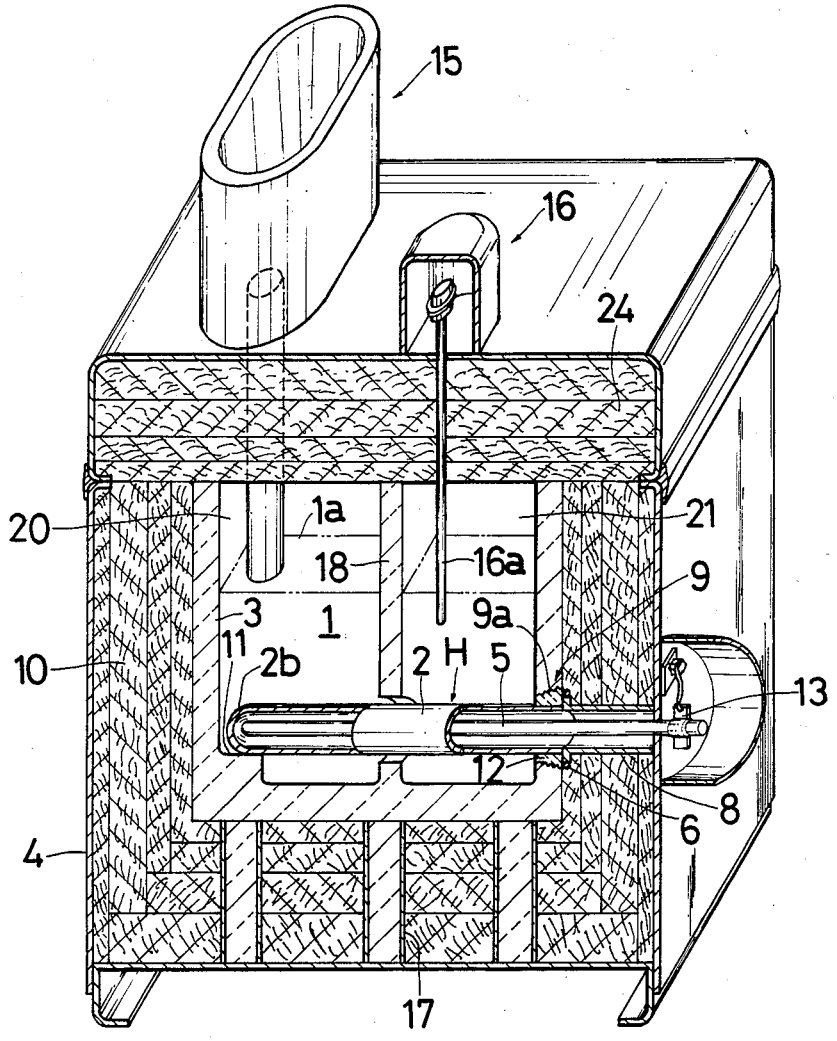
FIG. 1 is a sectional view showing a furnace according to a first embodiment of this invention.

FIGS. 1 and 2 show a first embodiment of an underheater type furnace for maintaining an aluminum alloy at a high temperature of 680°–720° C. after the deoxidation treatment, slug removing treatment and other treatments of a molten aluminum alloy prior to use in diecasting.

A furnace includes a refractory vessel 3 made of an integral or solid castable material for containing a molten aluminum alloy, a heat insulating layer 10 made of a ceramic fiber material and a furnace shell 4 made of a well-known metal. The heat insulating layer 10 is fixed outside of the vessel 3 for covering thermally the vessel 3. It is preferable that the heat insulating layer 10 consists of plural layers of ceramic fiber blankets as shown in FIG. 1. An aluminum foil can be inserted between the blankets. The reference 1*a* denotes a surface of the molten aluminum alloy 1 contained in the vessel 3.

The molten aluminum alloy 1 is heated by a heating means H which has a protective tube 2 and a heater 5 housed in the protective tube 2. The protective tube 2 protects the heater 5 from the molten aluminum alloy 1 in the vessel 3.

A tapered opening wall 9 is formed in a lower side portion of the vessel 3. The tapered opening wall 9 is outwardly widened and has tapered threads 9*a*. A sealing material 12 is disposed between the tapered opening wall 9 and the protective tube 2 so that the protective tube 2 is fixed relative to the vessel 3.

The protective tube 2 has an open end 2*a* and a closed end 2*b*.

The vessel 3 has a first support at a lower side portion thereof and a second suport 11 at an opposite side portion thereof. The first support includes the tapered opening wall 9. The second support 11 includes a stepped portion formed at a corner between the side and bottom walls of the vessel 3. The first support (the tapered opening wall 9) and the second support 11 (the stepped portion) are positioned at the opposite side walls of the vessel 3.

The open end 2*a* of the protective tube 2 is fixed at the first support of the tapered opening wall 9. The closed end 2*b* of the protective tube 2 is merely supported and not fixed by the second support 11. The protective tube 2 extends between the opposite side walls of the vessel 3 near its bottom wall.

As the closed end 2*b* of the protective tube 2 is not fixed to the second support 11 of a stepped shape, the closed end 2*b* of the protective tube 2 can move relative to the second support 11 except the downward direction.

A sensor has a portion 6 for detecting leakage of the molten aluminum alloy 1. The detecting portion 6 of the sensor is placed near the sealing material 12. It is preferable that the detecting portion 6 sensor is in a circle shape and faces toward the outside edge of the tapered opening wall 9. The detecting portion 6 is connected by way of a lead wire 6*a* to a control device (not shown) placed outside of the furnace.

As shown in FIG. 2, the open end 2*a* of the protective tube 2 ends at an outside surface of a side wall of the vessel 3 and is joined to one end of an auxiliary tube 8 made of a ceramic fiber material having good heat insulation which extends through the heat insulating layer 10 to the furnace shell 4. The auxiliary tube 8 has a flange 8*a* for contacting the sealing material 12 and the open end 2*a* of the protective tube 2.

The heater 5 is connected via a connector 13 to a control unit (not shown). A filling as above-mentioned may be provided between the protective tube 2 and the heater 5.

Figure 3:
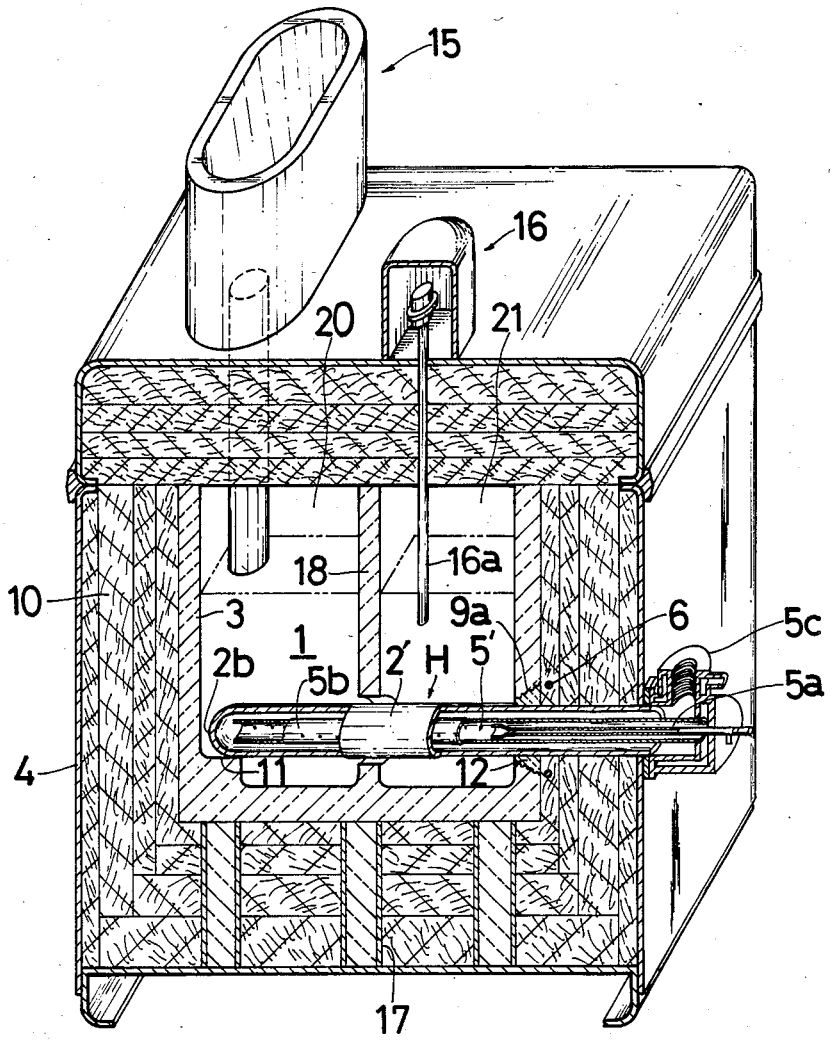
FIG. 3 is a sectional view showing a furnace according to a second embodiment of this invention.
Figure 4:
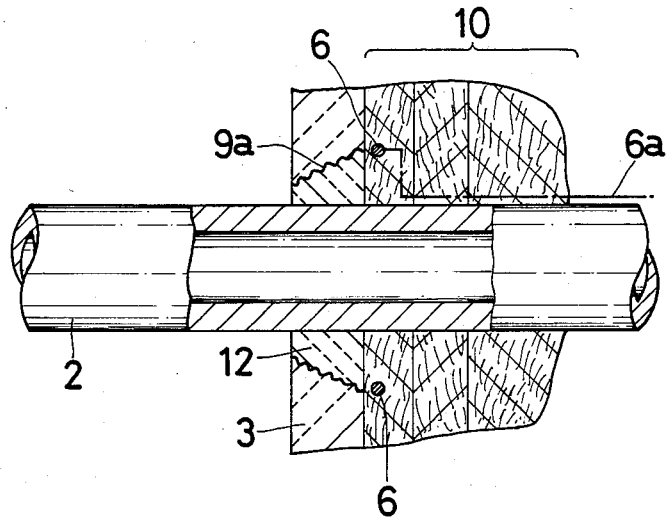
FIG. 4 is an enlarged sectional view showing a sealing material and its related portion of the second embodiment in which a heater is omitted.
Figure 5:
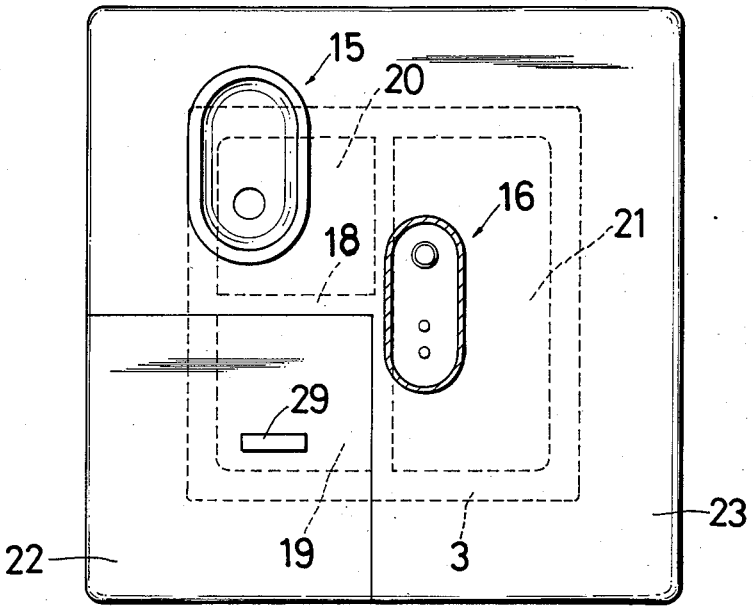
FIG. 5 is a plan view of the furnace shown in FIGS. 1 and 3.
Figure 6:
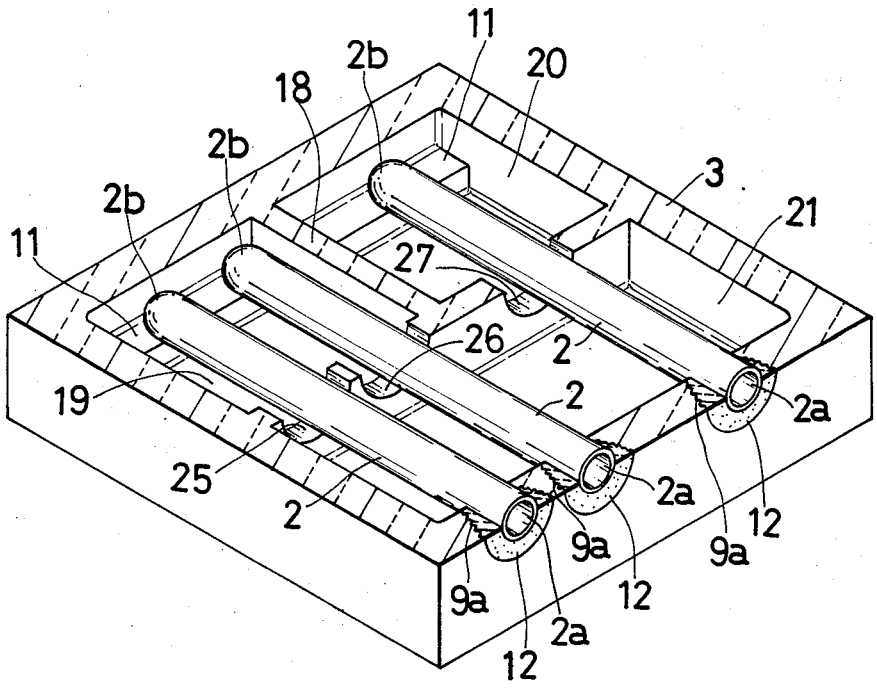
FIG. 6 is a perspective view, partly in section, of a lower portion of the furnaces shown in FIGS. 1 and 3.

FIGS. 3 and 4 show a second embodiment of this invention in which a gas burner type heater 5′ is employed as the heating means H. Except the heating means H, the second embodiment is substantially the same as the first embodiment. The gas burner type heater 5′ has a burner body 5*a* placed within an entrance portion of the protective tube 2. The tip of the burner body 5*a* is positioned near a sidewall of the vessel 3. A pipe 5*b* having many small through-holes at many predetermined positions is set in the protective tube 2 and extends to the closed end 2*b* thereof. The hot gas burned at the tip of the burner body 5*a* flows through the small openings of the pipe 5*b* into a circular clearance between the protective tube 2 and the pipe 5*b*. Thereafter, the hot gas flows to the right and then through an exit 5*c* into the atmosphere. An example of the gas burner type heater 5′ is disclosed in Japanese Patent Publication No. 57-40406.

That publication describes the gas heater as formed of concentrically arranged "inner and outer tubes," corresponding here to 5*b* and 2, respectively. Combustion occurs primarily within the inner tube 5*b*. The outer tube or protective tube 2 is heated by the products of combustion flowing through the annular space between its inner surface and the inner tube 5*b* and by flue jetting through the small openings of pipe or inner tube 5*b*.

In the second embodiment, the open end 2*a* of the protective tube 2 extends through the heat insulating layer 10. Therefore, an auxiliary tube made of a heat insulating material can be shortened or omitted.

In the first and second embodiments, a partition wall 18 is formed in the vessel 3. The partition wall 18 defines a first chamber 19 constituting a ladling chamber, a second chamber 20 for pouring the molten metal into the vessel 3, and a third chamber 21 positioned between the first and second chambers 19, 20 for detecting the temperatures and levels of the molten metal 1 in the vessel 3. The first and third chambers 19, 21 are connected through two openings 25, 26 formed in a lower portion of the partition wall 18. The second and third chambers 20, 21 are connected through an opening 27 formed in a lower portion of the partition wall 18. Although the partition wall 18 in the shown embodiments is formed in a T shape, the invention is not limited to only such a shape.

Three protective tubes 2 are horizontally arranged in parallel to each other and penetrate through the openings 25, 26, 27, respectively.

A small enclosure 22 for closing only the ladling chamber 19 is separate from a main enclosure 23. The enclosures 22, 23 include a ceramic fiber layer 24. A handle 29 is fixed to an upper portion of the small enclosure 22. By holding the handle 29, the small enclosure 22 can be opened so as to ladle the molten metal in the ladling chamber 19. The small enclosure 22 may be of a sliding type.

A sensor unit 16 is attached to the main enclosure 23 above the third chamber 21 for sensing a predetermined upper and lower limits of the surface level and the temperatures of the molten metal in the vessel 3. The sensor unit 16 has a protective tube **16*a* made of a SiC material a lower end of which is closed. The sensor unit 16 may be connected to the control unit connected to the sensor 6** for detecting the leakage of the molten metal as abovementioned.

A pouring device 15 is fixed to the main enclosure 23 above the second or pouring chamber 20 as best shown in FIG. 7. The inner wall **15*a* of the pouring device 15 is tapered. A pipe-like portion 15*b* is made of a ceramic fiber material and has a metal net therein for the reinforcing purpose. If the inner diametr of the pipe-like portion 15*b*** is small, large impurities can be filtered at the upper end thereof.

The reference 17 denotes plural ceramic tubes for supporting the vessel 3.

Although only the holding furnaces have been described, this invention can be applied to a furnace for melting a low melting point metal.

We claim:

1. An under-heater type furnace for maintaining a molten metal at high temperature, comprising:

a refractory vessel made of a castable material and having a furnace chamber for containing the molten metal;

a heat insulating layer of a ceramic fiber material covering the exterior of the refractory vessel;

a heater;

a protective tube, located within said furnace chamber, made of ceramic and having a closed end and an open end for housing the heater and protecting the heater from the molten metal in the refractory vessel;

first and second supports for the protective tube located within said furnace chamber, on opposite sides thereof;

said first support comprising a tapered opening in a side wall of said refractory vessel which widens outwardly toward the exterior of said refractory vessel and which has tapered threads;

a sealing material disposed within the tapered wall opening, surrounding the protective tube for fixing the protective tube relative to the vessel;

said second support supporting the closed end of the protective tube in such a manner that the closed end of the protective tube can freely move relative to the second support.

2. The under-heater type furnace of claim 1, further comprising a partition wall for defining a molten metal ladling chamber in the refractory vessel.

3. The under-heater type furnace of claim 1, wherein the heater is an electric heater.

4. The under-heater type furnace of claim 3, wherein the heater has a heating portion made of silicon carbide.

5. The under-heater type furnace of claim 1, wherein the heater is of a gas burner type.

6. The under-heater type furnace of claim 1, further comprising a sensor having a portion placed near the sealing material for detecting leakage of the molten metal between the protective tube and the tapered opening wall.

7. The furnace of claim 1 wherein said sealing material contains alumina-silica fibers.

8. An under-heater type furnace for maintaining a molten metal at a high temperature, comprising:

a refractory vessel made of a castable material and having a furnace chamber for containing the molten metal;

a heat insulating layer of a ceramic fiber material covering the exterior of the refractory vessel;

a heater;

a protective tube, located within said furnace chamber, made of ceramic and having a closed end and an open end for housing the heater and protecting the heater from the molten metal in the refractory vessel;

first and second supports for the protective tube located within said furnace chamber, on opposite sides thereof;

said first support comprising a tapered opening in a side wall of said refractory vessel which widens outwardly toward the exterior of said refractory vessel;

a sealing material disposed within the tapered wall opening, surrounding the protective tube for fixing the protective tube relative to the vessel;

said second support supporting the closed end of the protective tube in such a manner that the closed end of the protective tube can freely move relative to the second support;

wherein the open end of the protective tube terminates at the exterior of the side wall of the vessel and is there joined to one end of an auxiliary tube made of a heat resistant ceramic fiber material which extends through the heat insulating layer.

9. The under-heater type furnace of claim 8, wherein the auxiliary tube has a flange at said one end which contacts the sealing material and the open end of the protective tube.

10. The under-heater type furnace of claim 1, wherein a plurality of the protective tubes each housing the heater are horizontally arranged in parallel to each other.

11. The under-heater type furnace of claim 1, wherein the vessel has an upper opening which is closed by an enclosure having a heat insulating layer made of a ceramic fiber material.

12. The furnace as defined by claim 8 wherein said protective tube is formed of a silicon carbide ceramic.

* * * * *